US005182487A

United States Patent [19]

Ohtsu

[11] Patent Number: 5,182,487

[45] Date of Patent: Jan. 26, 1993

[54] DEFLECTION YOKE DEVICE

[75] Inventor: Shinji Ohtsu, Tokyo, Japan

[73] Assignee: Murata Mfg. Co., Ltd., Kyoto, Japan

[21] Appl. No.: 577,126

[22] Filed: Sep. 4, 1990

[30] Foreign Application Priority Data

Sep. 19, 1989 [JP] Japan ..... 1-109528[U]

[51] Int. Cl.[5] ..... H01J 29/70

[52] U.S. Cl. ..... 313/440; 313/414; 313/437; 335/211; 335/212; 335/213

[58] Field of Search ..... 313/414, 440, 437, 431, 313/412; 335/211, 212, 213; 358/248, 249; 315/368.25, 368.26, 368.27

[56] References Cited

U.S. PATENT DOCUMENTS

| | | | |
|---|---|---|---|
| 3,573,525 | 4/1971 | Fuse | 313/431 |
| 4,227,122 | 10/1980 | Fujisawg et al. | 335/213 |
| 4,642,527 | 2/1987 | Takahashi | 335/213 |
| 4,677,349 | 6/1987 | Ruby | 315/368.26 |
| 4,900,919 | 2/1990 | Shimoma et al. | 313/437 |
| 4,961,021 | 10/1990 | Ogurao et al. | 313/440 |

FOREIGN PATENT DOCUMENTS

| | | | |
|---|---|---|---|
| 2629019 | 1/1978 | Fed. Rep. of Germany | 335/213 |
| 0078137 | 3/1990 | Japan | 313/440 |
| 0614476 | 7/1978 | U.S.S.R. | 313/440 |
| 0741348 | 6/1980 | U.S.S.R. | 335/213 |

*Primary Examiner*—Donald J. Yusko
*Assistant Examiner*—Nimeshkumar Patel
*Attorney, Agent, or Firm*—Oliff & Berridge

[57] ABSTRACT

A deflection yoke device for deflecting an electron beam traveling in the interior of a CRT. The distribution of a magnetic field supplied by horizontal deflection coils to the interior of the CRT forms a barrel magnetic field on the panel side and the neck side, as viewed from the horizontal deflection coils, and a pin magnetic field in an intermediate space therebetween. The deflection yoke device of the invention is provided with a correction coil on the neck side, as viewed from the horizontal deflection coils so as to correct the neck-side magnetic field produced by the horizontal deflection coils into the barrel magnetic field of a greater intensity. The distortion of a beam focus caused by the pin magnetic field is thereby corrected.

20 Claims, 5 Drawing Sheets

DEFLECTION YOKE DEVICE

BACKGROUND OF THE INVENTION

Field of the Invention

The present invention relates to a deflection yoke device and more particularly to a deflection yoke device having a means for reducing the distortion of a beam focus.

Description of the Related Arts

Conventionally, cathode ray tubes (CRTs) are used for television receivers and display units. The CRT is a device for causing an electron beam traveling in its interior to bombard fluorescent materials arranged on a panel so as to display an image on the panel.

In the CRT, the fluorescent materials are disposed in a planar configuration so as to display a two-dimensional image. Accordingly, it is essential to provide a means for causing an electron beam to bombard the fluorescent materials located at predetermined positions at predetermined cycles. The deflection yoke device constitutes such a means, and is a means for deflecting an electron beam in the CRT.

The deflection yoke device generally has a horizontal deflection coil and a vertical deflection coil. Upon receipt of a horizontally deflecting current of a predetermined frequency, the horizontal deflection coil produces a horizontally deflecting magnetic field. Similarly, the vertical deflection coil, upon receiving a vertically deflecting current of a predetermined frequency, produces a vertically deflecting magnetic field.

The deflection yoke device is mounted on a side wall of the CRT. Both the horizontally and vertically deflecting magnetic fields are supplied to the interior of the CRT. The horizontally deflecting magnetic field deflects the electron beam in the horizontal direction of the screen, while the vertically deflecting magnetic field deflects the electron beam in the vertical direction of the screen. As a result, the electron beam bombards the fluorescent materials disposed at predetermined positions, thereby allowing a two-dimensional image to be displayed on the CRT panel.

As the modes of winding of the horizontal and vertical deflection coils, mainly two types are conventionally known. They are a toroidal-type winding and a saddle-type winding.

The horizontal deflection coils are generally wound into a saddle-type configuration, while the vertical deflection coils are generally wound toroidally.

FIG. 14 shows a deflection yoke device having those winding modes, illustrating an external side view thereof taken from the direction of the panel when the device is mounted on the CRT.

In the drawing, there is shown an insulating bobbin 10 formed of a resin. The bobbin 10 has a horn-shaped configuration, and is mounted along a tapered side surface of the CRT. In the drawing, the front side corresponds to a wide opening portion facing the CRT panel.

A core 12 formed of a magnetic substance such as ferrite is fitted around the outside of the bobbin 10. The core comprises two core pieces and are fitted around the bobbin 10 in such a manner as to clamp the bobbin 10 from opposite sides thereof.

Furthermore, horizontal deflection coils 14-1, 14-2 are wound on the internal surface of the bobbin. The horizontal deflection coils 14-1, 14-2 are bound to an inner wall of the bobbin 10 one on each horizontally opposite side, as viewed in the drawing, in such a manner that the direction of the core is oriented toward the interior of the CRT. In this drawing, a binding member is omitted. Meanwhile, vertical deflection coils 16-1, 16-2 are wound toroidally around the core 10 one on each upper and lower side, as viewed in the drawing.

FIG. 15 illustrates another type of winding, in which the vertical deflection coils are also wound into a saddle-type configuration (wound in the same manner as the horizontal deflection coils in FIG. 14).

That is, horizontal deflection coils 24-1, 24-2 are wound on the internal surface of a bobbin 20 in the same way as FIG. 14, and vertical deflection coils 26-1, 26-2 are wound into a saddle-type configuration on an external surface of the bobbin 20. A core 22 is fitted around the outer sides of the vertical deflection coils 26-1, 26-2.

This type of winding is used frequently when the deflection frequency is high as compared with the configuration shown in FIG. 14, and tends to be used frequently in conjunction with the trend in recent years toward a finer definition of images displayed on the panel.

The horizontally deflecting magnetic field supplied to the interior of the CRT by the horizontal deflection coils generally has a distribution such as is shown in FIG. 16.

FIG. 16 shows a schematic cross section of the CRT, illustrating a distribution 38 of a magnetic field produced by horizontal deflection coils 34. It should be noted that only one piece is shown as the horizontal deflection coils 34 for the sake of simplicity, and the arrangement of a bobbin and the like is omitted.

As shown in this drawing, in the regions on a panel 40 side of the CRT and the neck side thereof where an electron gun 42 is accommodated, the distribution of a magnetic field produced by the horizontal deflection coil 34 is inclined toward the barrel side, while in an intermediate region therebetween, the distribution is inclined toward the pin side.

Generally, the pin magnetic field overcomes the pin distortion of a raster pattern appearing on the panel (i.e., a vertical distortion of the raster pattern). For this reason, numerous improvements of design have been examined so that the distribution of the magnetic field will become the pin magnetic field on the panel 40 side, and deflection yoke devices capable reducing the pin distortion by virtue of these improvements have been adopted widely.

However, if the overall distribution of the horizontally deflecting magnetic field is moved toward the pin side, the magnetic field distribution on the neck side is also inclined toward the pin side. If the magnetic field distribution on the neck side is inclined toward the pin side, the beam focus becomes distorted.

Thus, it has hitherto been difficult to obtain a deflection yoke device capable of both overcoming the pin distortion of the raster pattern and improving the beam focus.

SUMMARY OF THE INVENTION

Accordingly, an object of the present invention is to provide a deflection yoke device which is capable of both overcoming the pin distortion of a raster pattern and improving a beam focus.

To this end, a deflection yoke device in accordance with one aspect of the present invention comprises:

a) two horizontal deflection coils that are respectively wound into a saddle-type configuration at mutually opposing positions on an outer side of a tapered side wall of a CRT and are adapted to supply a horizontally deflecting magnetic field to the interior of the CRT upon receipt of a horizontally deflecting current so as to horizontally deflect an electron beam traveling in the CRT; and b) a correction coil disposed on a neck side of the CRT, as viewed from the horizontal deflection coils, and adapted to produce a barrel magnetic field synchronizing with the horizontally deflecting magnetic field.

In the present invention, the horizontally deflecting magnetic field produced by the horizontal deflection coils are corrected by the correction coil particularly on the neck side of the CRT. That is, a barrel magnetic field synchronizing with the horizontally deflecting magnetic field is produced by the correction coil. Accordingly, even when the horizontally deflecting magnetic field is inclined toward the pin side, that inclination can be corrected toward the barrel side. Meanwhile, the horizontally deflecting magnetic field on the panel side can be kept inclined toward the pin side, and the horizontally deflecting magnetic field on the neck side can be kept inclined toward the barrel side.

As a result, in accordance with this aspect of the invention, it is possible to suppress the pin distortion and correct the distortion of the beam focus.

In addition, in accordance with another aspect of the invention, there is provided a deflection yoke device wherein vertical deflection coils are also taken into consideration. That is, there is provided a deflection yoke device comprising:

a) two horizontal deflection coils that are respectively wound into a saddle-type configuration at mutually opposing positions on an outer side of a tapered side wall of a CRT and are adapted to supply a horizontally deflecting magnetic field to the interior of the CRT upon receipt of a horizontally deflecting current so as to horizontally deflect an electron beam traveling in the CRT;

b) two vertical deflection coils that are respectively wound into a saddle-type configuration at mutually opposing positions on the outer side of the tapered side wall of the CRT and are adapted to supply a vertically deflecting magnetic field to the interior of the CRT upon receipt of a vertically deflecting current so as to vertically deflect the electron beam traveling in the CRT; and c) a correction coil disposed on a neck side of the CRT, as viewed from the horizontal deflection coils, and adapted to produce a barrel magnetic field synchronizing with the horizontally deflecting magnetic field.

In accordance with the above-described arrangement as well, it is possible to obtain a similar effect.

In addition, in cases where a bobbin with an enlarged-diameter portion is provided on the neck side of the CRT, the following positions are conceivable as the position in which the correction coil is disposed:

b1) the neck side of the CRT, as viewed from the enlarged-diameter portion, b2) the inside of the enlarged-diameter portion, and b3) the panel side of the CRT, as viewed from the enlarged-diameter portion.

In cases where the correction coil is disposed in any of the aforementioned positions, it is possible to realize the correction of the horizontally deflecting magnetic field on the neck side of the CRT.

Furthermore, it suffices if a ring formed of a magnetic substance is disposed on the neck side of the CRT, as viewed from the horizontal deflection coil. In this arrangement, it is possible to absorb the leakage of the horizontally deflecting magnetic field or the vertically deflecting magnetic field.

The ring may be provided with a plurality of core legs projecting from an internal surface thereof toward the inner side of the CRT. A correction coil is wound around each of these core legs, and the core legs are provided projectingly at mutually opposing positions. This arrangement makes it possible to form the correction coils and the ring as one assembly.

It suffices if the correction coils are connected to the horizontal deflection coils. In this arrangement, the horizontally deflecting current is supplied to the correction coils. Accordingly, the horizontally deflecting magnetic field and the barrel magnetic field produced by the correction coils can be readily synchronized with each other.

It should be noted that, of the correction coils, those that are wound around mutually opposing ones of the core legs may be connected with each other either in series or parallel.

Furthermore, it is possible to employ two types of correction coils, one connected to the horizontal deflection coils and the other connected to the vertical deflection coils. In this case, as for the arrangement of the core legs, the correction coil connected to the horizontal deflection coils and the correction coils connected to the vertical deflection coils may be respectively wound around core legs that are oriented in mutually perpendicular directions.

DESCRIPTION OF THE PREFERRED EMBODIMENTS

Referring now to the accompanying drawings, a description will be given of the preferred embodiments of the present invention.

Figure 1:
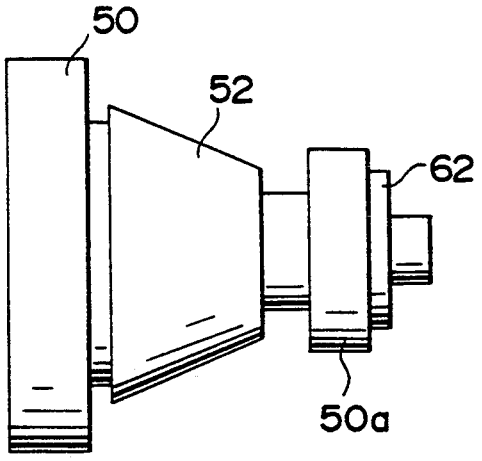
FIG. 1 is a diagram illustrating an external configuration of a deflection yoke device in accordance with a first embodiment of the present invention.
Figure 2:
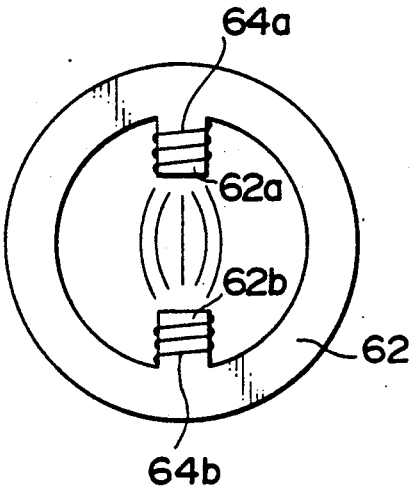
FIG. 2 is a plan view illustrating a configuration of a ring and winding structures of correction coils in accordance with the first embodiment.
Figure 3:
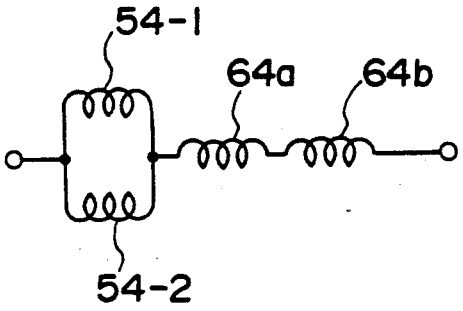
FIG. 3 is a circuit diagram illustrating a connection between horizontal deflection coils and the correction coils in accordance with the first embodiment.

FIGS. 1 to 3 illustrate a configuration of a deflection yoke device in accordance with a first embodiment of the present invention.

In this embodiment, a core 52 is fitted around an external surface of a bobbin 50 in the same way as the prior art. An enlarged-diameter portion 50*a* is provided at an end portion of the bobbin 50 on the side of a neck of a CRT.

A ring 62 is mounted at a position closer to the neck as viewed from the enlarged-diameter portion 50*a*. This ring 62 is formed of a magnetic substance such as a silicon steel plate, permalloy, ferrite, or the like.

As shown in FIG. 2, core legs 62*a*, 62*b* are provided projectingly on the inner periphery of the ring 62. Correction coils 64*a*, 64*b* are wound around the core legs 62*a*, 62*b*, respectively.

As shown in FIG. 3, the correction coils 64*a*, 64*b* are connected in series. The correction coils 64*a*, 64*b* connected in series are further connected to horizontal deflection coils 54-1, 54-2.

This embodiment has the above-described arrangement and operates as follows.

That is, when a horizontally deflecting current of sawtooth waveform is supplied to the horizontal deflection coils 54-1, 54-2, the horizontal deflection coils 54-1, 54-2 produce a horizontally deflecting magnetic field. Concurrently, the correction coils 64*a*, 64*b* produce a magnetic field synchronizing with the horizontally deflecting magnetic field, by means of the horizontally deflecting current.

In this case, the magnetic field produced by the correction coils 64*a*, 64*b* is one having a barrel configuration, i.e., a barrel magnetic field, as illustrated between the core legs 62*a* and 62*b* in FIG. 2. The barrel magnetic field is a general magnetic field which is produced between opposing core legs.

Therefore, in accordance with this embodiment, even in cases where the distribution of the horizontally deflecting magnetic field is inclined toward the pin on the neck side, the inclined distribution can be corrected toward the barrel side.

Figure 4:
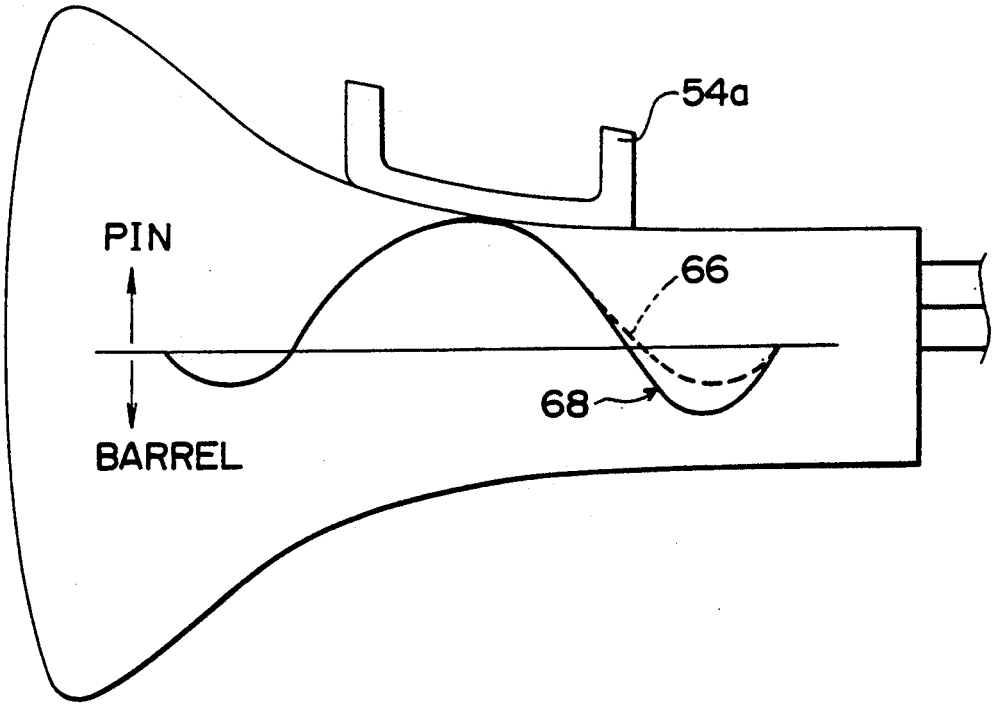
FIG. 4 is a schematic cross-sectional view of a CRT illustrating the effect of correction of a horizontally deflection magnetic field in accordance with the first embodiment.

For instance, as shown in FIG. 4, the distribution of the horizontally deflecting magnetic field indicated by a broken line 66 is corrected into the one shown by a solid line 68. At this time, no effect is exerted on the panel-side magnetic field.

Accordingly, it becomes possible to reduce the distortion of the beam focus while controlling the pin distortion of an image on the panel.

In addition, the ring 62 absorbs the leakage of the horizontally and vertically deflecting magnetic fields toward the neck portion. This effect is notable more the vertical deflection coils are toroidally wound. In general, the leakage of a vertically deflecting magnetic field is more notable in the case of the toroidal winding than in the case of the saddle-type winding; however, in this embodiment the leaking magnetic field is absorbed by the ring 62 formed of a magnetic substance. As a result, the effect of the magnetic field leaking to an external circuit and the focus is prevented.

Figure 5:
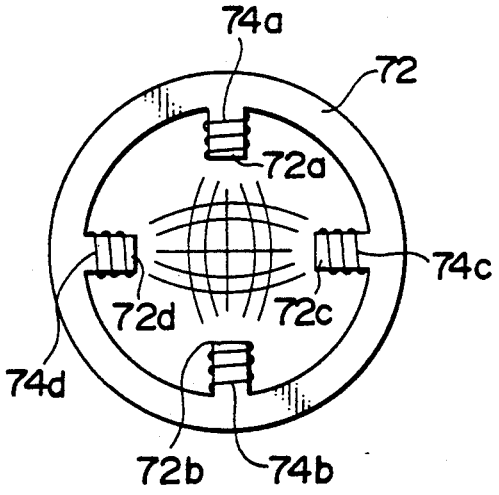
FIG. 5 is a plan view illustrating a configuration of a ring and winding structures of correction coils in accordance with a second embodiment.

FIG. 5 illustrates a configuration of a second embodiment of the present invention. In this drawing, only the configuration of a ring 72 and the winding structures of correction coils 74*a*, 74*b*, 74*c*, 74*d* are shown for the sake of simplicity.

In this embodiment, four core legs 72*a*, 72*b*, 72*c*, 72*d* are disposed on the inner side of the ring 72 at 90° intervals. In addition, the correction coils 74*a*, 74*b*, 74*c*, 74*d* are wound around the core legs 72*a*, 72*b*, 72*c*, 72*d*, respectively.

Figure 6:
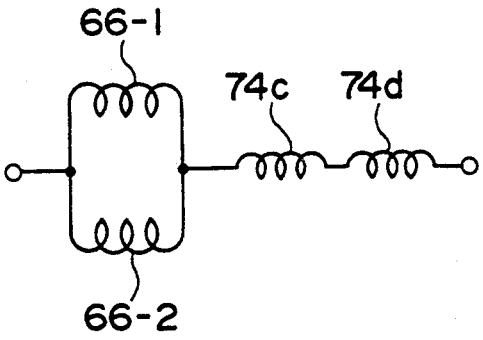
FIG. 6 is a circuit diagram illustrating a connection between a vertical deflection coil and the correction coils in accordance with the second embodiment.

FIG. 6 illustrates a connection of the correction coils 74*c*, 74*d* in accordance with this embodiment. Of the connection of the correction coils of this embodiment, the connection of the correction coils 74*a*, 74*b* is the same as that for the first embodiment. That is, after the correction coils 74*a*, 74*b* are connected in series with each other, they are connected to the horizontal deflection coils. For this reason, in FIG. 6, an illustration is given only with respect to the correction coils 74*c*, 74*d*.

As shown in this drawing, the correction coils 74*c*, 74*d* are connected in series, and are further connected to vertical deflection coils 66-1, 66-2 connected in parallel with each other.

In accordance with this embodiment as well, it is possible to obtain a similar effect to that of the first embodiment.

The inventor has conducted an experiment using the configurations of the first and second embodiments in order to ascertain the effect of the present invention. The results of this experiment show that it is possible to rectify the focus distortion by a maximum of 30% as compared with the prior art configuration.

Figure 7:
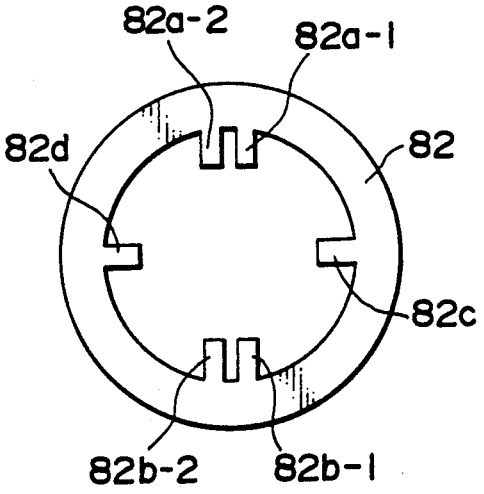
FIG. 7 is a plan view illustrating a configuration of a ring in accordance with a third embodiment.

FIG. 7 illustrates a configuration of a third embodiment of the present invention. In the case of this embodiment, a ring 82 comprises six poles. That is, six core legs 82*a*-1, 82*a*-2, 82*b*-1, 82*b*-2, 82*c*, 82*d* are provided. Of these core legs, correction coils connected to the horizontal deflection coils are wound around the four core legs 82*a*-1, 82*a*-2, 82*b*-1, 82*b*-2, while correction coils connected to the vertical deflection coils are wound around the two core legs 82*c*, 82*d*.

Figure 8:
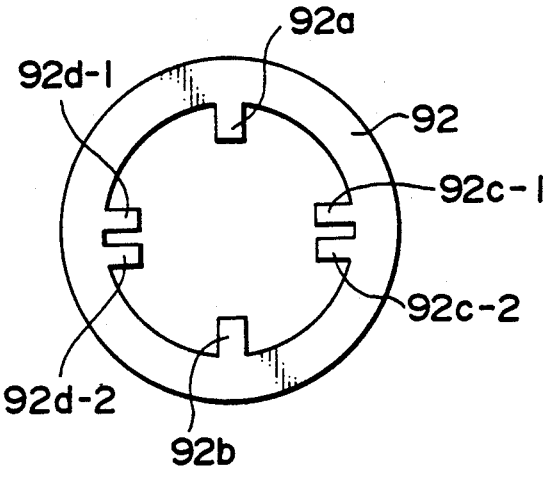
FIG. 8 is a plan view illustrating a configuration of a ring in accordance with a fourth embodiment.

FIG. 8 illustrates a configuration of a fourth embodiment of the present invention. In this embodiment, a ring 92 comprises six poles in the same way as the third embodiment. However, the correction coils connected to the vertical deflection coils are wound around not two core legs but four core legs. That is, the correction coils connected to the horizontal deflection coils are wound around core legs 92*a*, 92*b*, while the correction coils connected to the vertical deflection coils are wound around core legs 92*c*-1, 92*c*-2, 92*d*-1, 92*d*-2.

In accordance with both of these third and fourth embodiments, it is possible to obtain an effect similar to those of the first and second embodiments.

Figure 9:
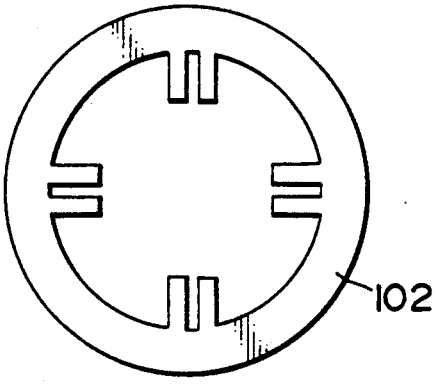
FIG. 9 is a plan view illustrating a configuration of a ring in accordance with a fifth embodiment.

FIG. 9 illustrates a configuration of a fifth embodiment of the present invention. In this embodiment, a ring 102 comprises eight poles. That is, the configuration provided is such that the core legs in the second embodiment are respectively halved.

In this embodiment as well, it is possible to obtain a similar effect to that of the second embodiment.

Figure 10:
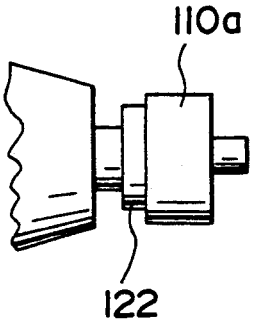
FIG. 10 is a side elevational view illustrating an arrangement of a ring in accordance with a sixth embodiment.
Figure 11:
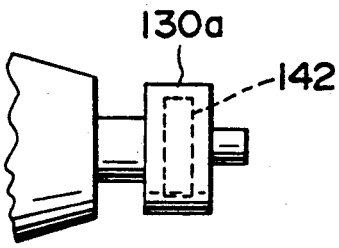
FIG. 11 is a side elevational view illustrating an arrangement of a ring in accordance with a seventh embodiment.

FIG. 10 illustrates a configuration of a sixth embodiment of the present invention, and FIG. 11 illustrates a configuration of a seventh embodiment of the present invention.

In the sixth embodiment, a ring 122 is disposed at a position closer to the panel as viewed from an enlarged-diameter portion 110*a*. In the seventh embodiment, a ring 142 is disposed inside an enlarged-diameter portion 130*a*. In these embodiments as well, it is possible to obtain an effect similar to those of the foregoing embodiments.

Figure 12:
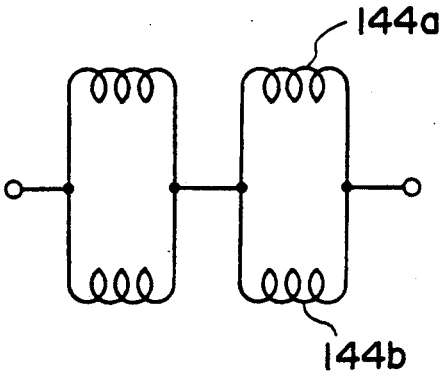
FIG. 12 is a circuit diagram illustrating a connection structure of a horizontal deflection coil in accordance with an eighth embodiment.
Figure 13:
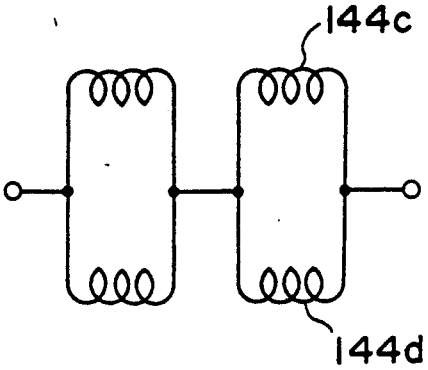
FIG. 13 is a circuit diagram illustrating a connection structure of a horizontal deflection coil in accordance with an ninth embodiment.
Figure 14:
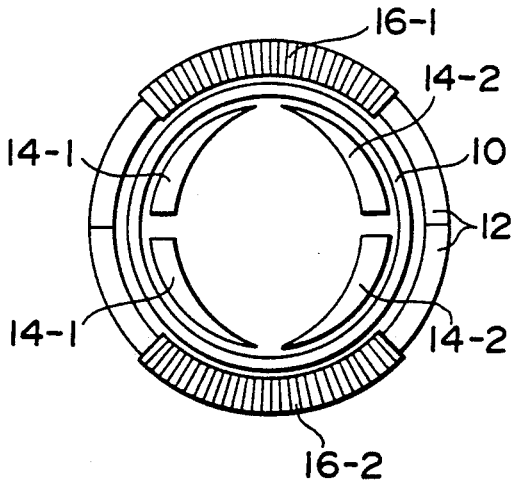
FIG. 14 PRIOR ART
FIG. 14 is plan view schematically illustrating a configuration of a deflection yoke device in which the horizontal deflection coils are wound into a saddle-type configuration and the vertical deflection coils are wound into a toroidal configuration.
Figure 15:
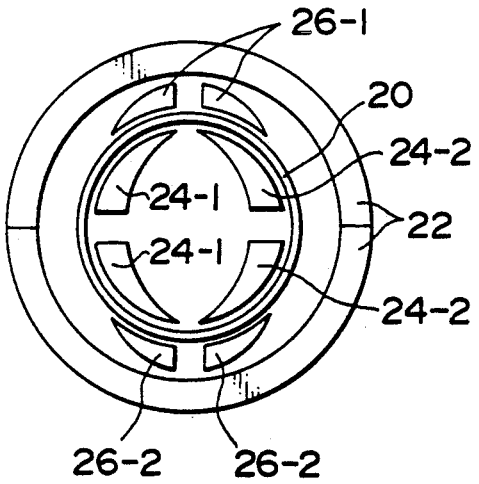
FIG. 15 PRIOR ART
FIG. 15 is plan view schematically illustrating a configuration of a deflection yoke device in which both the horizontal deflection coils and the vertical deflection coils are wound into a saddle-type configuration.
Figure 16:
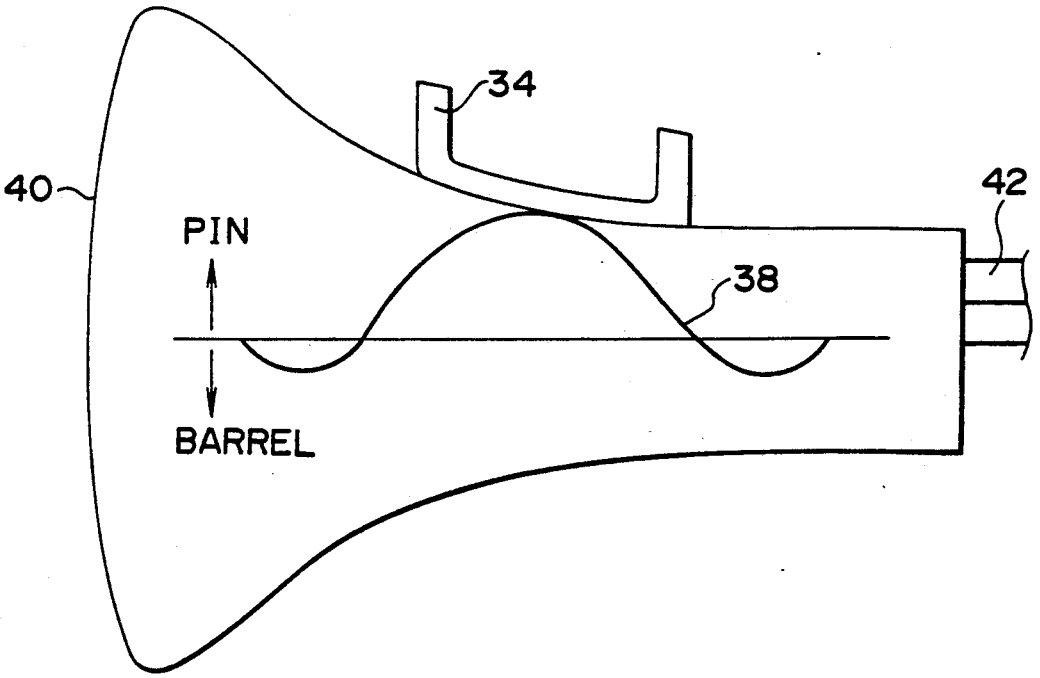
FIG. 16 PRIOR ART
FIG. 16 is a schematic cross-sectional view of a CRT illustrating the distribution of a horizontally deflecting magnetic field in accordance with a prior art.

FIG. 12 illustrates a configuration of an eighth embodiment of the present invention, and FIG. 13 illustrates a ninth embodiment of the present invention.

In the eighth embodiment, correction coils 144*a*, 144*b* connected to the horizontal deflection coils are connected in parallel. In the ninth embodiment, correction coils 144*c*, 144*d* connected to the vertical deflection coils are also connected in parallel.

In these embodiments as well, it is possible to obtain an effect similar to those of the preceding embodiments.

What is claimed is:

1. A deflection yoke device having two horizontal deflection coils that are respectively wound into a saddle-type configuration at mutually opposing positions on an outer side of a tapered side wall of a CRT and are adapted to supply a horizontally deflecting magnetic field to the interior of said CRT upon receipt of a horizontally deflecting current so as to horizontally deflect an electron beam traveling in said CRT, said deflection yoke device comprising:

at least one correction coil connected and proximal to said horizontal deflection coils and disposed on a neck side of said CRT, as viewed from said horizontal deflection coils, said at least one correction coil producing a barrel magnetic field synchronized with and for correcting the horizontally deflecting magnetic field while improving the electron beam focus.

2. A deflection yoke device according to claim 1, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed on the neck side of said CRT, as viewed from said enlarged-diameter portion.

3. A deflection yoke device according to claim 1, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed inside said enlarged-diameter portion.

4. A deflection yoke device according to claim 1, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed on a panel side of said CRT, as viewed from said enlarged-diameter portion.

5. A deflection yoke device according to claim 1, further comprising a ring disposed on the neck side of said CRT, as viewed from said horizontal deflection coils, and formed of a magnetic substance.

6. A deflection yoke according to claim 5, wherein said at least one correction coil includes a plurality of correction coils; said ring has a corresponding plurality of core legs provided projectingly on an inner periphery thereof at mutually opposing positions, each one of said plurality of correction coils being would around corresponding ones of said plurality of core legs.

7. A deflection yoke device according to claim 6, wherein said at least one correction coil is connected to said horizontal deflection coils.

8. A deflection yoke device according to claim 7, wherein, correction coils that are wound around corresponding core legs which are mutually opposing, are connected in series.

9. A deflection yoke device according to claim 7, wherein, correction coils that are wound around corresponding core legs which are mutually opposing, are connected in parallel.

10. A deflection yoke device having two horizontal deflection coils that are respectively wound into a saddle-type configuration at mutually opposing positions on an outer side of a tapered side wall of a CRT and are adapted to supply a horizontally deflecting magnetic field to the interior of said CRT upon receipt of a horizontally deflecting current so as to horizontally deflect an electron beam traveling in said CRT, said deflection yoke device also having two vertical deflection coils that are respectively wound into a saddle-type configuration at mutually opposing positions on the outer side of said tapered side wall of said CRT and are adapted to supply a vertically deflecting magnetic field to the interior of said CRT upon receipt of a vertically deflecting current so as to vertically deflect the electron beam traveling in said CRT, said deflection yoke device comprising:

at least one correction coil connected and proximal to said horizontal deflection coils and disposed on a neck side of said CRT, as viewed from said horizontal deflection coils, said at least one correction coil producing a barrel magnetic field synchronized with and for correcting the horizontally deflecting magnetic field while improving the electron beam focus.

11. A deflection yoke device according to claim 10, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed on the neck side of said CRT, as viewed from said enlarged-diameter portion.

12. A deflection yoke device according to claim 10, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed inside said enlarged-diameter portion.

13. A deflection yoke device according to claim 10, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein said at least one correction coil is disposed on a panel side of said CRT, as viewed from said enlarged-diameter portion.

14. A deflection yoke device according to claim 10, further comprising a ring disposed on the neck side of said CRT, as viewed from said horizontal deflection coils, and formed of a magnetic substance.

15. A deflection yoke device according to claim 14, wherein said at least one correction coil includes a plurality of correction coils; said ring has a plurality of core legs provided projectingly on an inner periphery thereof at mutually opposing positions, each one of said plurality of correction coils being wound around corresponding ones of said plurality of core legs.

16. A deflection yoke device according to claim 15, wherein at least one of said plurality of correction coils is connected to said horizontal deflection coils, and remaining ones thereof are connected to said vertical deflection coils.

17. A deflection yoke device according to claim 16, wherein correction coils that are wound around corresponding core legs which are mutually opposing, are connected in series.

18. A deflection yoke device according to claim 16, wherein correction coils that are wound around corresponding core legs which are mutually opposing, are connected in parallel.

19. A deflection yoke device according to claim 16, wherein said at least one of said plurality of correction coils is connected to said horizontal deflection coils and said correction coils connected to said vertical deflection coils are respectively wound around core legs that are oriented in mutually perpendicular directions.

20. A deflection yoke device according to claim 19, further comprising:

an enlarged-diameter portion disposed on the neck side of said CRT; and a horn-shaped bobbin mounted on the outer side of said tapered side wall of said CRT and adapted to hold said horizontal deflection coils on said side wall, wherein a ring is disposed on the neck side of said CRT, as viewed from said enlarged diameter portion, and wherein, said at least one correction coil comprises a plurality of correction coils, and said correction coils that are wound around corresponding core legs which are mutually opposing, are connected in series.

* * * * *